US008567622B2

(12) United States Patent
Yourist et al.

(10) Patent No.: US 8,567,622 B2
(45) Date of Patent: Oct. 29, 2013

(54) DOME SHAPED HOT-FILL CONTAINER

(75) Inventors: Sheldon E. Yourist, York, PA (US); Raymond A. Pritchett, Jr., Brogue, PA (US); Matthew T. Gill, Hellam, PA (US)

(73) Assignee: Graham Packaging Company, L.P., York, PA (US)

( * ) Notice: Subject to any disclaimer, the term of this patent is extended or adjusted under 35 U.S.C. 154(b) by 516 days.

(21) Appl. No.: 12/549,016

(22) Filed: Aug. 27, 2009

(65) Prior Publication Data

US 2011/0049084 A1 Mar. 3, 2011

(51) Int. Cl.
*B65D 1/02* (2006.01)
*B65D 1/46* (2006.01)

(52) U.S. Cl.
USPC ..... 215/381; 215/384; 220/666; 220/675

(58) Field of Classification Search
USPC ..... 215/381–384, 398; 220/675, 673, 666
See application file for complete search history.

(56) References Cited

U.S. PATENT DOCUMENTS

| | | | | |
|---|---|---|---|---|
| D44,100 | S | 5/1913 | Guidry | |
| D98,951 | S | 3/1936 | Lewis | |
| D166,731 | S | 5/1952 | Blunt | |
| D219,262 | S | 11/1970 | Lamelet | |
| 4,805,788 | A | 2/1989 | Ahiko | |
| 4,818,575 | A | 4/1989 | Hirata et al. | |
| 4,946,053 | A | 8/1990 | Conrad | |
| 5,067,622 | A | 11/1991 | Garver et al. | |
| 5,178,290 | A * | 1/1993 | Ota et al. | 215/382 |
| 5,199,588 | A | 4/1993 | Hayashi | |
| 5,222,615 | A | 6/1993 | Ota et al. | |
| 5,238,129 | A | 8/1993 | Ota | |
| 5,310,068 | A | 5/1994 | Saghri | |
| 5,381,910 | A * | 1/1995 | Sugiura et al. | 215/398 |
| D419,058 | S | 1/2000 | Roth et al. | |
| 6,164,474 | A * | 12/2000 | Cheng et al. | 215/384 |
| 6,213,326 | B1 * | 4/2001 | Denner et al. | 215/383 |
| D455,351 | S | 4/2002 | Bailey | |
| D466,021 | S | 11/2002 | Thierjung et al. | |
| D466,024 | S | 11/2002 | Thierjung et al. | |
| D485,765 | S | 1/2004 | Thierjung et al. | |
| D494,475 | S | 8/2004 | Thierjung et al. | |
| D497,551 | S | 10/2004 | Gamel et al. | |
| D501,404 | S | 2/2005 | Dalton et al. | |
| D502,100 | S | 2/2005 | Bretz et al. | |
| D510,025 | S | 9/2005 | Venkataraman et al. | |
| D512,312 | S | 12/2005 | Bretz et al. | |
| D513,591 | S | 1/2006 | Ducret | |
| D526,565 | S | 8/2006 | Griffin et al. | |
| D535,884 | S | 1/2007 | Davis et al. | |
| 7,165,693 | B2 * | 1/2007 | Oguchi et al. | 215/381 |
| D538,661 | S | 3/2007 | Wolf et al. | |
| D547,664 | S | 7/2007 | Davis et al. | |
| D568,753 | S | 5/2008 | Woolf | |
| D571,214 | S | 6/2008 | Caszatt | |
| D580,763 | S | 11/2008 | Perez | |
| 7,455,189 | B2 * | 11/2008 | Lane et al. | 215/381 |
| 7,467,725 | B2 * | 12/2008 | Tanaka et al. | 215/381 |
| D588,917 | S | 3/2009 | Shmagin | |
| D592,518 | S | 5/2009 | Faulon | |

(Continued)

*Primary Examiner* — Sue A Weaver
(74) *Attorney, Agent, or Firm* — Baker Botts L.L.P.

(57) ABSTRACT

A container has a domed shaped top portion that is located above the body portion. The body portion connects with the domed shaped top portion via a waist portion that has a variable distance from the longitudinal axis of the container.

20 Claims, 9 Drawing Sheets

(56) References Cited

U.S. PATENT DOCUMENTS

| | | | | |
|---|---|---|---|---|
| D592,969 | S | 5/2009 | Hazelton et al. | |
| D595,143 | S | 6/2009 | Hazelton et al. | |
| 7,552,833 | B2 * | 6/2009 | Tsutsui et al. | 215/381 |
| D600,122 | S | 9/2009 | Strasser et al. | |
| 8,083,082 | B2 * | 12/2011 | Sasaki | 215/384 |
| 8,113,369 | B2 * | 2/2012 | Mast et al. | 215/381 |
| 2002/0104820 | A1 * | 8/2002 | Hong et al. | 215/381 |
| 2004/0129598 | A1 * | 7/2004 | Zhang et al. | 206/524.8 |
| 2005/0067369 | A1 * | 3/2005 | Trude | 215/381 |
| 2005/0218107 | A1 * | 10/2005 | Sabold et al. | 215/382 |
| 2005/0247664 | A1 * | 11/2005 | Lane et al. | 215/381 |
| 2007/0090120 | A1 * | 4/2007 | Bezek | 220/675 |
| 2007/0170143 | A1 * | 7/2007 | Shmagin | 215/381 |

* cited by examiner

DOME SHAPED HOT-FILL CONTAINER

BACKGROUND OF THE INVENTION

1. Field of the Invention

The present invention is related to the field of containers. In particular the present invention is related to hot-fill containers.

2. Description of the Related Technology

In the past, containers used for the storage of products, such as beverages, were made of glass. Glass was used due to its transparency, its ability to maintain its structure and the ease of affixing labels to it. However, glass is fragile and heavy. This results in lost profits due to broken containers during shipping and storage caused by the usage of glass and additional costs due to the transportation of heavier materials.

Plastic containers are used more frequently today due to their durability and lightweight nature. Polyethylene terephthalate (PET) is used to construct many of today's containers. PET containers are lightweight, inexpensive, recyclable and manufacturable in large quantities.

PET containers are used for products, such as beverages. Often these liquid products, such as juices and isotonics, are placed into the containers while the liquid product is at an elevated temperature, typically between 68° C.-96° C. (155° F.-205° F.) and usually about 85° C. (185° F.). When packaged in this manner, the hot temperature of the liquid is used to sterilize the container at the time of filling. This process is known as hot-filling. The containers that are designed to withstand the process are known as hot-fill containers.

The use of blow molded plastic containers for packaging hot-fill beverages is well known. However, a container that is used in the hot-fill process is subject to additional stresses on the container that can result in the container failing during storage or handling or to be deformed in some manner. The sidewalls of the container can become deformed and/or collapse as the container is being filled with hot fluids. The rigidity of the container can decrease after the hot-fill liquid is introduced into the container.

After being hot-filled, the hot-filled containers are capped and allowed to reside at about the filling temperature for a predetermined amount of time. The containers and stored liquid may then be cooled so that the containers may be transferred to labeling, packaging and shipping operations. As the liquid stored in the container cools, thermal contraction occurs resulting in a reduction of volume. This results in the volume of liquid stored in the container being reduced. The reduction of liquid within the sealed container results in the creation of a negative pressure or vacuum within the container. If not controlled or otherwise accommodated for, these negative pressures result in deformation of the container which leads to either an aesthetically unacceptable container or one which is unstable. The container must be able to withstand such changes in pressure without failure.

The negative pressure within the container has typically been compensated for by the incorporation of flex panels in the sidewall of the container, Traditionally, these paneled areas have been semi-rigid by design and are unable to accommodate the high levels of negative pressure generated in some lightweight containers. Currently, hot-fill containers typically include substantially rectangular vacuum panels that are designed to collapse inwardly after the container has been filled with hot product. These flex panels are designed so that as the liquid cools, the flex panels will deform and move inwardly. The adjacent portions of the container, which are located between, above, and below the flex panels, are intended to resist any deformations which would otherwise be caused by hot-fill processing. Wall thickness variations, or geometric structures, such as ribs, projections and the like, can be utilized to prevent unwanted distortion. Generally, the typical hot-fillable container structure is provided with certain pre-defined areas which flex to accommodate volumetric changes and certain other pre-defined areas which remain unchanged.

An important aspect of creating a container that can withstand the hot-fill process without deformation is to create one with aesthetic. An increase in aesthetic appeal of a container improves sales of the product found within the container. However, certain aesthetic designs are difficult to incorporate into a hot-fill container due to the need to accommodate the negative pressure that occurs during the hot-fill process. Especially difficult is the incorporation of spherical features and certain types of labeling due to typical incorporation of strengthening measures. Therefore, a need exists to develop a hot-fillable container that can incorporate select features without compromising the usage of the features due to the need of strengthening structure.

SUMMARY OF THE INVENTION

An object of the present invention is a hot-fill container that has a dome shaped top portion.

Another object of the invention is a hot hot-fill container that has a waist portion that is adapted to support the domed shaped top portion on a hot-fill container.

Still yet another object of the invention is a hot-fill container having a groove located proximate to its base.

An aspect of the present invention may be a hot-fillable container comprising: a domed shaped top portion having a longitudinal axis; a waist portion located below the top portion, a body portion located below the waist portion; a base located below the body portion; and wherein a distance from the waist portion to the longitudinal axis is non-constant and a distance from the waist portion to the base portion is non-constant.

Another aspect of the present invention may be a hot-fillable container comprising: a domed shaped top portion; a waist portion located below the top portion, wherein the waist portion comprises four corners; a body portion located below the waist portion, wherein the body portion comprises four sides; a base located below the body portion; and wherein a distance from the corners of the waist portion to the base is greater than the distance from any other location on the waist portion to the base.

Still yet another aspect of the present invention may be a hot-fillable container comprising: a domed shaped top portion; a waist portion located below the top portion, wherein the waist portion forms a plurality of arcs; a body portion located below the waist portion, wherein the body portion is adapted to accommodate a hot-fill process; a circular base located below the body portion.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
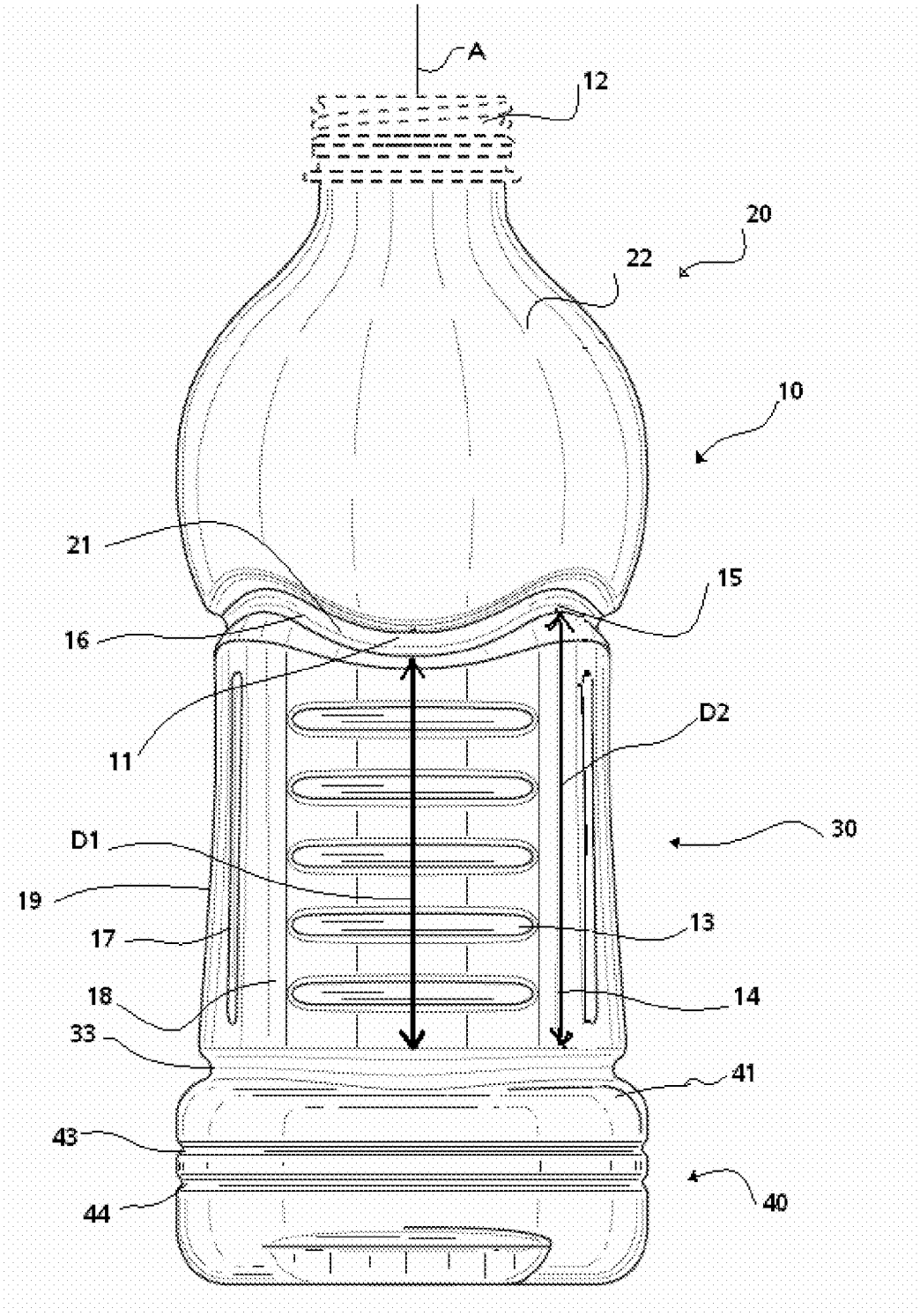
FIG. 1 is a front view of a container in accordance with an embodiment of the present invention.

Referring now to the drawings, wherein like reference numerals designate corresponding structure throughout the views, FIG. 1 shows a hot-fill container 10 in its finished form. The hot-fill container 10 may be used to package a wide variety of liquid and/or viscous products such as juices, and other fluids and beverages that are amenable to the hot-fill process. The container 10 may be scaled to accommodate from between 10 ounces to 58 ounces, and is preferably shaped to accommodate between 16 ounces to 48 ounces size and have the capability for a full shrink label, a partial shrink label or even a spot label.

The container 10 may be a one-piece construction and may be prepared from a monolayer plastic material, such as a polyamide, for example, nylon; a polyolefin such as polyethylene, for example, low density polyethylene (LDPE), high density polyethylene (HDPE), polypropylene, a polyester, for example, polyethylene terephthalate (PET), polyethylene naphtalate (PEN), or others, which may also include additives to vary the physical or chemical properties of the material. For example, some plastic resins may be modified to improve the oxygen permeability. Alternatively, the container may be prepared from a multilayer plastic material. The layers may be any plastic material, including virgin, recycled and reground material. The layers and may include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties. In an exemplary embodiment, the present container is prepared from PET.

The container 10 is constructed to withstand the rigors of hot-fill processing. The container 10 may be made by a conventional blow molding processes including, for example, extrusion blow molding, stretch blow molding and injection blow molding. These molding processes are discussed briefly below.

For example, with extrusion blow molding, a molten tube of thermoplastic material, or plastic parison, is extruded between a pair of open blow mold halves. The blow mold halves close about the parison and cooperate to provide a cavity into which the parison is blown to form the container. As so formed, container 10 may include extra material, or flash, at the region where the molds come together. A moil may be intentionally present above the container finish.

After the mold halves open, the container 10 drops out and is then sent to a trimmer or cutter where any flash of moil attached to the container 10 is removed. The finished container 10 may have a visible ridge (not shown) formed where the two mold halves used to form the container came together. This ridge is often referred to as the parting line.

With stretch blow molding a pre-formed parison, or preform, is prepared from a thermoplastic material, typically by an injection molding process. The pre-form typically includes an opened, threaded end, which becomes the threaded member of the container 10. The pre-form is positioned between two open blow mold halves. The blow mold halves close about the pre-form and cooperate to provide a cavity into which the pre-form is blown to form the container. After molding, the mold halves open to release the container 10. For wide mouth containers, the container 10 may then be sent to a trimmer where the moil is removed.

With injection blow molding, a thermoplastic material may be extruded through a rod into an injection mold in order to form a parison. The parison is then positioned between two open blow mold halves. The blow mold halves close about the parison and cooperate to provide a cavity into which the parison may be blown to form the container 10. After molding, the mold halves open to release the container 10.

Plastic blow-molded containers, particularly those molded of PET, are utilized in hot-fill applications. Hot-filling involves filling the container 10 with a liquid product heated to a temperature in excess of 180° F. (i.e., 82° C.), capped immediately after filling, and then allowed to cool to ambient temperatures.

In the construction of containers it is important to keep the container's top load and hot-fill performance characteristics strong. The structural integrity of the container must be maintained after the hot-fill process. Furthermore, consideration must be made for preventing bulging of the container 10 that can occur with rectangular containers.

Figure 2:
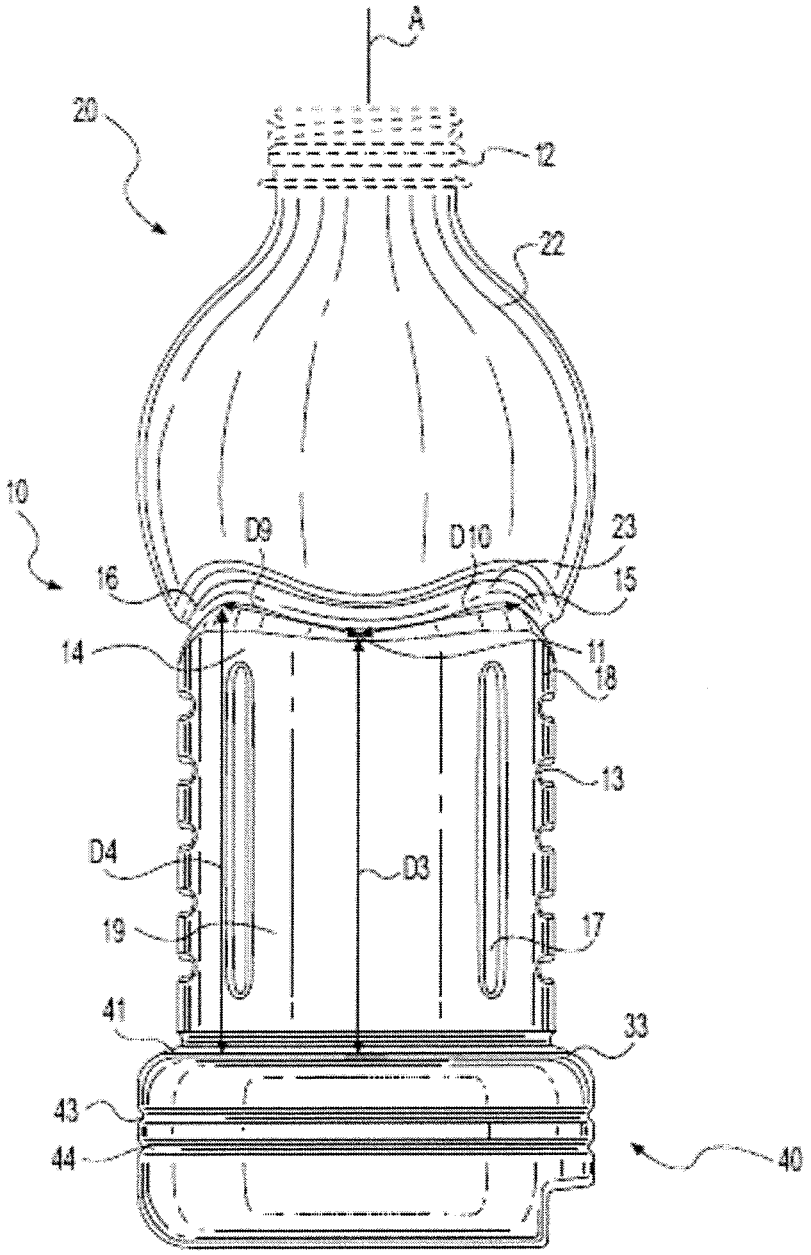
FIG. 2 is a side view of the container shown in FIG. 1.
Figure 3:
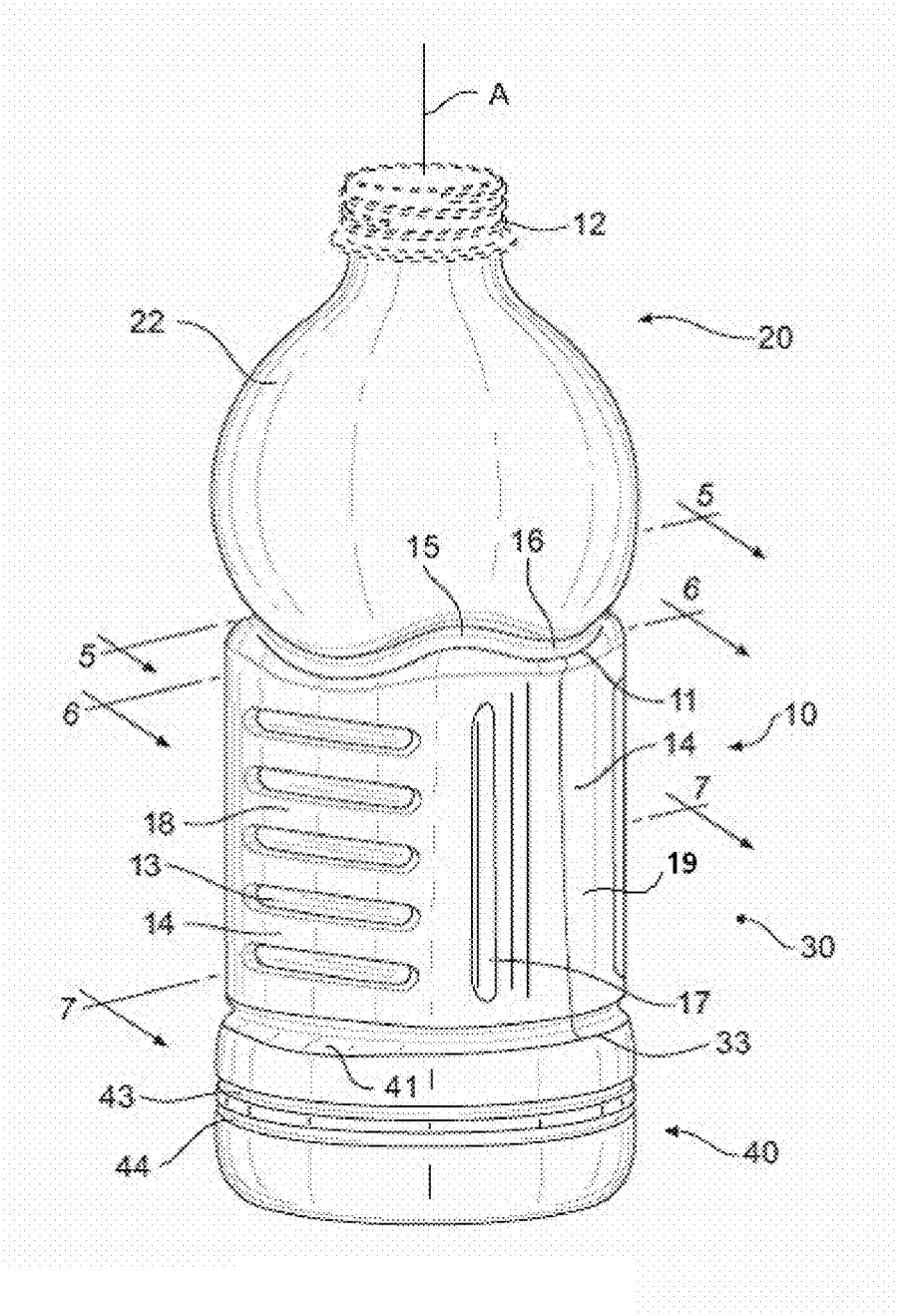
FIG. 3 is a perspective view of the container shown in FIG. 1.

Now turning to FIGS. 1-3, wherein a front view, side view and perspective view of the hot-fillable container 10 having a longitudinal axis A is shown. The container 10 has a top portion 20, a waist portion 16, a body portion 30 and a base portion 40. The top portion 20 is comprised of a wall 22, which is curved in order to form a dome shaped appearance. While the top portion 20 shown in FIG. 1 is circumferentially and spherically shaped in the view shown, it should be understood that the shape of the top portion 20 may be more than spherically shaped and may have some other ovoid shape provided a circumferential aspect of the top portion 20 is retained. Located above the top portion 20 is a threaded portion 12 upon which a cap is placed.

Located below the top portion 20 is the shoulder portion 16. The shoulder portion 16 merges the top portion 20 in to the body portion 30 and is recessed with respect to the outer surfaces of the top portion 20 and the body portion 30. The waist portion 16 is adapted to enable the placement of the dome shaped top portion 20 on the body portion 30. The waist portion 16 shown in FIGS. 1-3 has four corner portions 15 and is comprised of four separate arcs located on each of the sides 14. Arc 21 are located above label panel side 18 and are more curved than arcs 23, which are located above vacuum panel sides 19. The arc shape of the waist portion 16 prevents the container from buckling during the hot fill process. As may be seen in the drawings, waist portion 16 has a substantially constant vertical width and extends in the preferred embodiment about and entire circumference of the container. As shown, the waist portion 16 is located above the four sides 14 of the body portion 30, with each of the arcs having a midpoint waist portion 11 located at the center of the arc, which is the point taken from the closest point on the waist portion 16 to the portion of the side 14 which merges with a groove 33 located above the base 40 of the container 10. The mid-point 11 is also located mid-way between the corner portions 15. Each of the four mid-point waist portions 11 is located equidistantly from the corner portions 15, however the two mid-point waist portions 11 located on arcs 21 will be located closer to the groove 33 than the two mid-point waist portions 11 located on arc 23. For example the distance D9 shown in FIG. 2 is equal to the distance D10, while the distance D1 from the midpoint of the arc 21 to the portion of the side 14 which merges with a groove 33 located above the base 40 of the container 10 is less than the distance D3 from the midpoint of the arc 23 to the portion of the side 14 which merges with a groove 33 located above the base 40 of the container 10. For example in one embodiment, the distances for D9 and D10 may be 32.97 mm, while the distance D1 may be 84.37 mm and the distance D3 may be 88.01 mm. It should be understood that if the body portion 30 has more or less than four sides 14 than there would be more than four corner portions 15 with the number of corners 15 corresponding to the number of the sides 14.

The body portion 30 shown in FIGS. 1-3 comprises a plurality of sides 14 which may be interconnected. The container shown in FIGS. 1-3 shows four sides 14, however it should be understood that more or less sides 14 could be employed. In the present invention, four sides 14 are used in order to form the body 30 with a rectangular appearance. The four sides 14 comprise two labeling sides 18 having ribs 13 used to facilitate labeling. The labeling side 18 merges into the top portion 41 of the base 40. The four sides 14 further comprise two vacuum flex panels 19. The vacuum flex panels 19 are adapted to accommodate the negative pressure that occurs within the container 10 during the hot-fill process. Each of the vacuum flex panels 19 have two strengthening ribs 17 that are adapted to permit the flexure of the panels 19 without deforming the overall appearance of the container 10.

Located at the bottom of the panel 19 and side 18 is a groove 33. The groove 33 extends horizontally along the flex panel 19. The groove 33 is continuous and extends along the bottom of the body 30 and along the top of the base 40. The groove 33 permits that base 40 to be increased in capacity without affecting the aesthetics of the container 10 and permits the container 10 to be stouter in appearance.

The base 40 has a top base portion 41 which merges with the groove 33. The base 40 may also have two ribs 43 and 44, which further increase the strength of the base 40. The base 40 shown in the FIGS. is cylindrical in shape, The ribs 43 and 44 are continuous circumferential ribs and additionally assist in increasing the overall capacity of the base 40. Additionally, the base 40 may be extended in order to increase the overall capacity of the container 10 without having to increase the diameter of the container 10.

As shown in FIG. 1, the distances from the portions of the waist 16 to groove 33 and the base 40 are non-constant. The distance D1 from the mid-point waist portion 11 on the arc 21 to the portion of the side 14 which merges with the groove 33 located above the base 40 is greater than the distance D3 taken from the mid-point waist portion 11 on the arc 23 to the portion of the side 14 which merges with a groove 33 located above the base 40 of the container 10. Furthermore, the distance D2 taken from the corner portion 15 to the portion of the side 14 which merges with the groove 33 of the base 40 is greater than distance D1. For example, the distance D2 may be 93.62 mm, while the distance D1 may be 84.37 mm Likewise, the distance D4 taken on the panel 19 is greater than the distance D3. For example the distance D4 may be 93.62 mm, while the distance D3 may be 88.01 mm. The non-constant nature of the waist portion 16 may be seen in more detail in the perspective view shown in FIG. 3.

Figure 4:
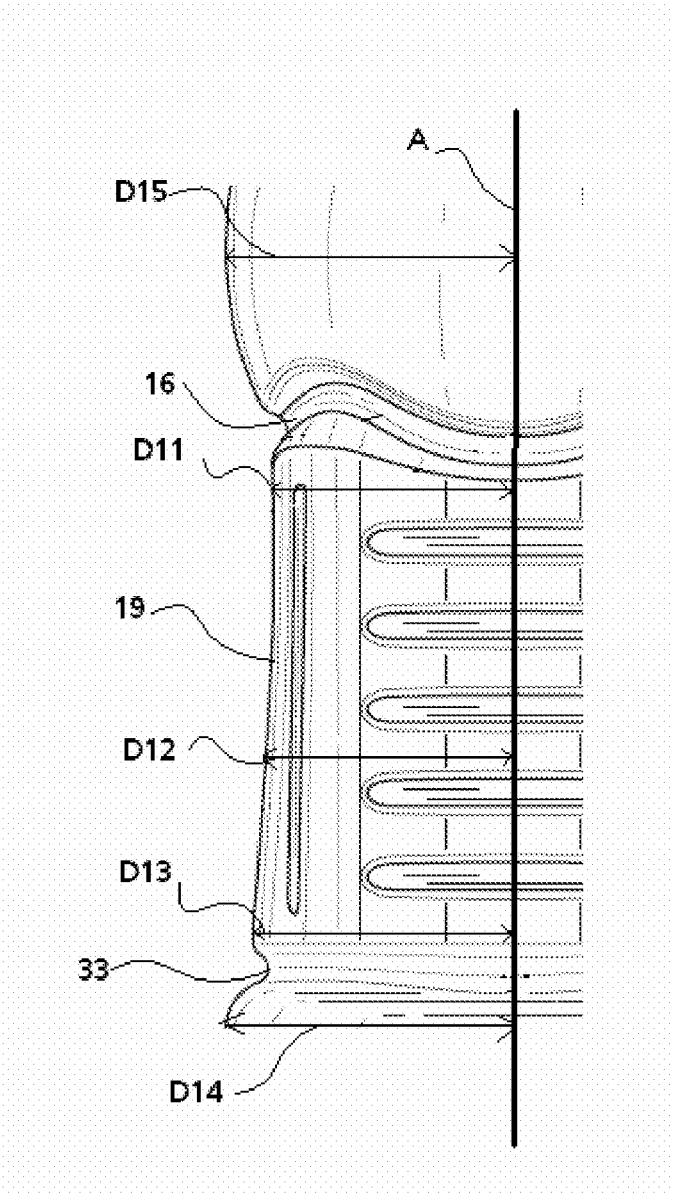
FIG. 4 is a partial view of the container shown in FIG. 1 illustrating the distances of the sides from the longitudinal axis.

FIG. 4 is a partial view of the container shown in FIG. 1 illustrating the distances of the sides from the longitudinal axis A to the vacuum flex panel 19. The distances from the sides of the vacuum flex panel 19 to the longitudinal axis varies as it extends from the waist portion 16 to the groove 33. Furthermore, the distances from the surfaces of the top portion 20 and the base portion 40 to the longitudinal axis are also shown in FIG. 4.

As shown in FIG. 4 the distance D11 from the longitudinal axis A to the surface of the flex panel 19 is less than the distance D12 from the longitudinal axis A to the surface of the flex panel 19. This is due to a majority of the vacuum being taken up by the portion of the flex panel 19 in the upper central half of the panel 19. Furthermore, the distance D13 from the surface of the flex panel 19 to the longitudinal axis A is greater than either D11 or D12, for example the distance D13 may be 42.43 mm, while the distance D11 may be 39.72 mm and the distance D12 may be 43.58 mm, Therefore the distances D11, D12 and D13 gradually get larger as the base 40 of the container 10 is approached. The increase in the distances represents how the flex panel 19 accommodates the hot-fill process primarily in the upper portion of the flex panel 19. The distance D15 taken from the longitudinal axis A to the surface of the top portion 20 is greater than the distances D11, D12 and D13. The distance D15 is equal to the distance D14, which is taken from the surface of the base 40 to the longitudinal axis D14. The distances D15 and D14 are the greatest distances located on the container 10 from the longitudinal axis A and provide the area of the container 10 that is used for provision of contact with portions of the fill machinery.

Figure 5:
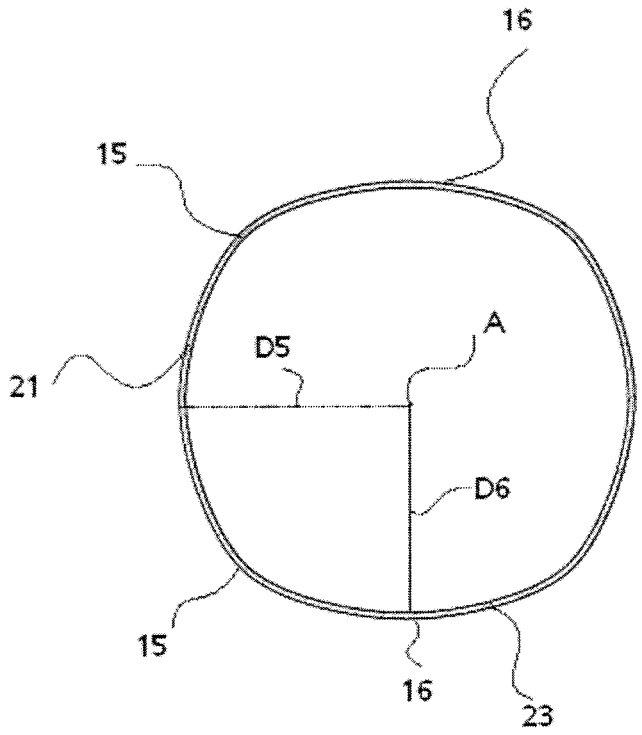
FIG. 5 is a cross-sectional view of the container taken along the line 5-5 in FIG. 3.

Now referring to FIG. 5, a cross-sectional view of the waist 16 taken along line 5-5 in FIG. 3 is shown. Shown in the view are the corner portions 15 and the waist 16. Shown in the cross-sectional view is how the distance D5 from the arc 21 to the longitudinal axis A is greater than the distance D6 from the longitudinal axis A to the arc 23, for example the distance D5 may be 39.72 mm, while the distance D6 may be 38.47 mm. This is due to the complex curvature required in order to obtain the desired shape of the container 10 and isolate the vacuum intake and deformation absorbed by the panel 19.

Figure 6:
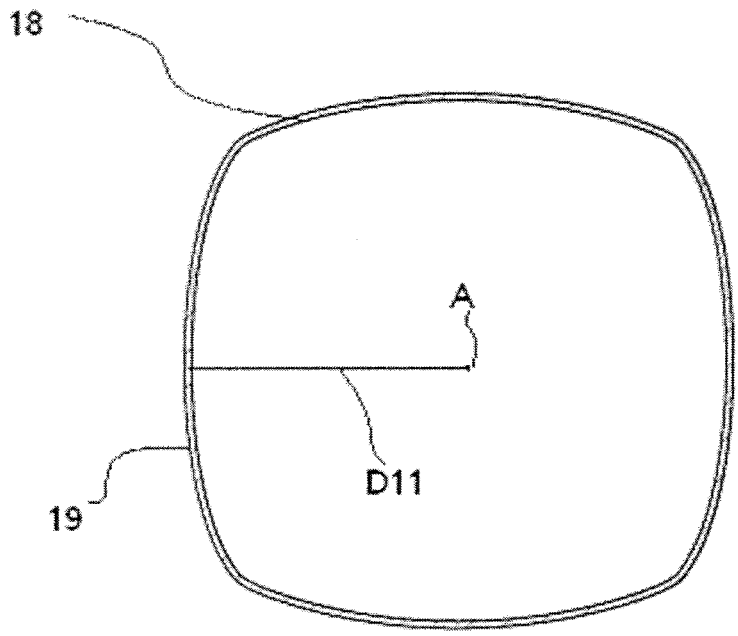
FIG. 6 is a cross-sectional view of the container taken along the line 6-6 in FIG. 3.
Figure 7:
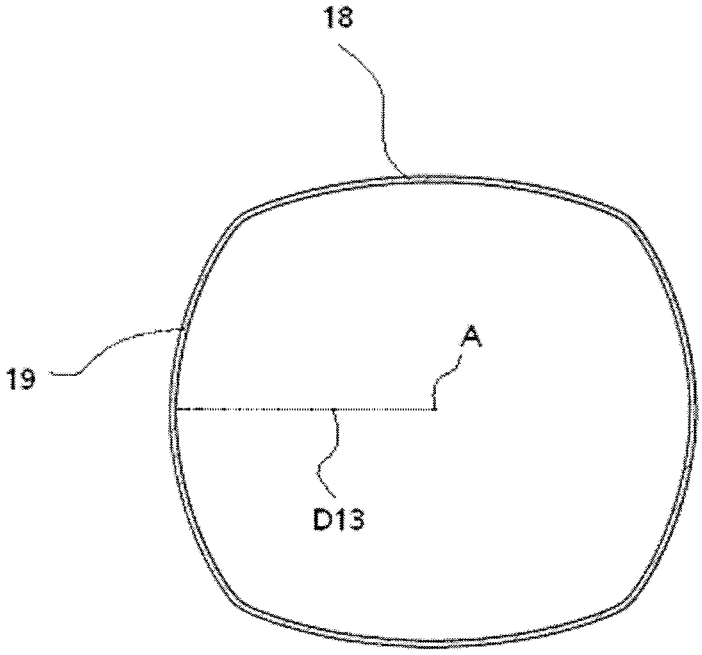
FIG. 7 is a cross-sectional view of the container taken along the line 7-7 in FIG. 3.

FIG. 6 is a cross-sectional view of the body 30 taken along the line 6-6 in FIG. 3. Shown in the view is the distance D11 from the longitudinal axis A to the outer surface of the panel 19. FIG. 7 is a cross-sectional view of the body 30 taken along the line 7-7 in FIG. 3. Shown in the view is the distance D13 from the longitudinal axis A to the outer surface of the panel 19. The distance D13 is greater than the distance D11 and represents how the panel 19 absorbs more of the vacuum intake closer to the waist 16 than towards to the groove 33.

Figure 8:
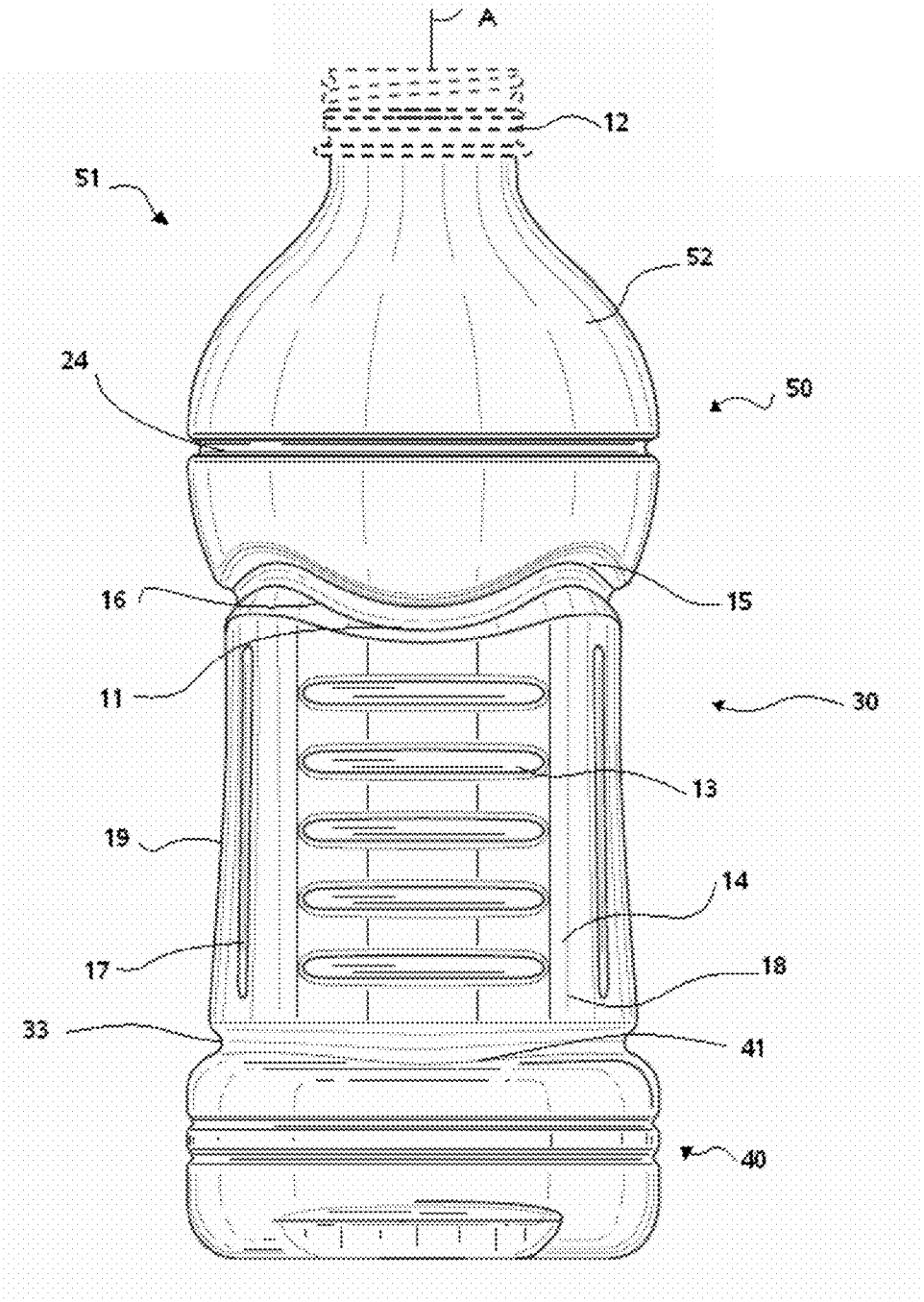
FIG. 8 is front view of a container in accordance with another embodiment of the present invention.

FIG. 8 shows an alternative embodiment of the present invention wherein the container 50 has a top portion 51 having a rib 24. Formed within the wall 52 is the rib 24. The rib 24 is a continuous circumferential rib 24 and as shown is equally spaced from the longitudinal axis A. The rib 24 may alternatively be formed so that it is not continuous and is instead comprises randomly spaced rib components. The rib 24 may strengthen the structure of the top portion 20 and further assist in the placement and retaining of a label and in maintaining the spherical shape of the top portion 20.

Figure 9:
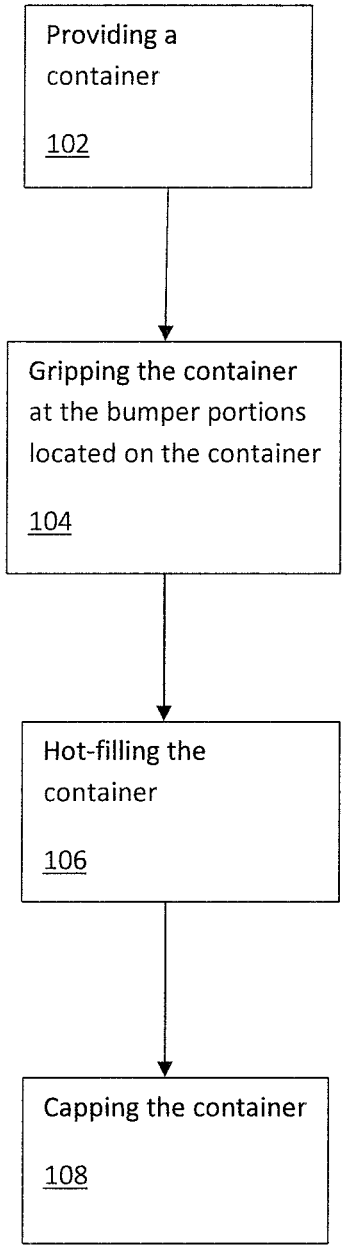
FIG. 9 is flow chart showing the hot fill process.

FIG. 9 is flow chart providing the steps of hot filling the container 10. The same method is applicable to each of the containers disclosed herein. In step 102, the container 10 is provided. In step 104, the container 10 is filled with a liquid. In step 106, the container 10 is capped.

Typically a container having two round sections, such as the top portion 20 and the base 40 in the present invention, and a square body will respond to the vacuum pressure equally and thus result in deformation. The structure of the container 10 permits the accommodation of a shrink film, a partial shrink film, or a glued spot label due to the isolated deformation due to vacuum pressure. The structure permits the panels 19 to take up most of the vacuum while trying to stabilize the label sides 18 without deforming. The undulating ring is localizing the changes in the body. The container 10 is also able to be accommodated on many existing co-packer filling lines. Additionally, the structure of the container 10 permits a clean aesthetic appearance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A hot-fillable container comprising:

a domed shaped top portion having a longitudinal axis;

a waist portion located below the top portion;

a body portion located below the waist portion, the waist portion having a substantially constant vertical width and being recessed with respect to adjacent outer surfaces of both the top portion and the body portion;

the body portion having a flexible panel having an upper end and a lower end, and wherein a first distance from a surface of the flexible panel near the upper end to the longitudinal axis is less than a second distance from the surface of the flexible panel near the lower end to the longitudinal axis;

a base portion located below the body portion; and wherein a distance from the waist portion to the longitudinal axis is non-constant and a distance from the waist portion to the base portion is non-constant.

2. The hot-fillable container of claim 1, wherein the waist portion comprises four corner portions, wherein the distance from each of the four corner portions to the longitudinal axis is equal.

3. The hot-fillable container of claim 1, wherein the waist portion comprises four corner portions, and four mid-point waist portions, wherein two of the four mid-point waist portions are located a first distance from a bottom of the body portion and two of the four mid-point waist portions are located a second distance from the bottom of the body portion, wherein the first distance is greater than the second distance.

4. The hot-fillable container of claim 1, wherein the domed shaped top portion further comprises a continuous circumferential rib.

5. The hot-fillable container of claim 1, wherein the body portion comprises four interconnected sides.

6. The hot-fillable container of claim 5, wherein the body portion further comprises a groove located above the base portion.

7. The hot-fillable container of claim 5, wherein a groove is located above the base portion on two of the sides.

8. The hot-fillable container of claim 5, wherein two of the sides are vacuum flex panels and further wherein the distance from the outer surface of the vacuum flex panels to the longitudinal axis increases from the waist portion to a bottom of the body portion.

9. The hot-fillable container of claim 5, wherein the base portion has two circumferential ribs.

10. A hot-fillable container comprising:

a domed shaped top portion;

a waist portion located below the top portion, wherein the waist portion comprises four corner portions;

a body portion located below the waist portion, wherein the body portion comprises four sides, the waist portion having a substantially constant vertical width and being recessed with respect to adjacent outer surfaces of both the top portion and the body portion;

the body portion further having a flexible panel having an upper end and a lower end, and wherein a first distance from a surface of the flexible panel near the upper end to the longitudinal axis is less than a second distance from the surface of the flexible panel near the lower end to the longitudinal axis;

a base portion located below the body portion; and wherein a distance from the corner portions of the waist portion to a bottom of the body portion is greater than the distance from any other location on the waist portion to the bottom of the body portion.

11. The hot-fillable container of claim 10, wherein the distances from each of the four corner portions to the base portion are equal.

12. The hot-fillable container of claim 10, wherein the waist portion further comprises four mid-point waist portions, wherein two of the four mid-point waist portions are located a first distance from a bottom of the body portion and two of the four mid-point waist portions are located a second distance from the bottom of the body portion, wherein the first distance is greater than the second distance.

13. The hot-fillable container of claim 10, wherein the domed shaped top portion further comprises a continuous circumferential rib.

14. The hot-fillable container of claim 10, wherein the body portion further comprises a groove located above the base portion.

15. The hot-fillable container of claim 10, wherein a groove is located above the base portion on two sides.

16. The hot-fillable container of claim 10, wherein two of the sides are vacuum flex panels and further wherein the distance from the outer surface of the vacuum flex panels to the longitudinal axis increases from the waist portion to a bottom of the body portion.

17. The hot-fillable container of claim 10, wherein the base portion has two circumferential ribs.

18. A hot-fillable container comprising:

a domed shaped top portion;

a waist portion located below the top portion, wherein the waist portion forms a plurality of arcs;

a body portion located below the waist portion, wherein the body portion is adapted to accommodate a hot-fill process, the waist portion having a substantially constant vertical width and being recessed with respect to adjacent outer surfaces of both the top portion and the body portion;

the body portion further having a flexible panel having an upper end and a lower end, and wherein a first distance from a surface of the flexible panel near the upper end to the longitudinal axis is less than a second distance from the surface of the flexible panel near the lower end to the longitudinal axis;

a circular base located below the body portion.

19. The hot-fillable container of claim 18, wherein four arcs are formed.

20. The hot-fillable container of claim 19, wherein the four arcs are continuously connected.

* * * * *